US007520150B2

(12) United States Patent
Yu

(10) Patent No.: US 7,520,150 B2
(45) Date of Patent: Apr. 21, 2009

(54) LOCK WITH INDICATOR AND MULTIPLE KEY-ACTUATED CORE

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

(21) Appl. No.: 11/503,989

(22) Filed: Aug. 15, 2006

(65) Prior Publication Data

US 2008/0000274 A1 Jan. 3, 2008

(30) Foreign Application Priority Data

Jun. 30, 2006 (TW) ..... 95124020 A

(51) Int. Cl.
*E05B 67/00* (2006.01)
*E05B 41/00* (2006.01)

(52) U.S. Cl. ..... 70/31; 70/21; 70/25; 70/432; 70/435; 70/437; 70/340

(58) Field of Classification Search ..... 70/284, 70/285, 20–29, 432, 435, 441, 437, 31, 35, 70/337–340

See application file for complete search history.

(56) References Cited

U.S. PATENT DOCUMENTS

| | | | | |
|---|---|---|---|---|
| 6,047,577 | A * | 4/2000 | Klimas | 70/340 |
| 6,708,534 | B1 | 3/2004 | Ruan | |
| 6,877,345 | B1 * | 4/2005 | Misner et al. | 70/25 |
| 7,007,521 | B1 | 3/2006 | Misner et al. | |
| 7,100,401 | B2 * | 9/2006 | Yu | 70/21 |
| 2004/0226323 | A1 | 11/2004 | Ling et al. | |
| 2004/0226324 | A1 | 11/2004 | Loughlin et al. | |
| 2005/0262902 | A1 * | 12/2005 | Ling et al. | 70/21 |
| 2005/0262903 | A1 * | 12/2005 | Ling et al. | 70/21 |
| 2006/0107708 | A1 * | 5/2006 | Yu | 70/21 |
| 2006/0107709 | A1 * | 5/2006 | Yu | 70/21 |
| 2006/0254325 | A1 * | 11/2006 | Yu | 70/21 |

* cited by examiner

*Primary Examiner*—Patricia L Engle
*Assistant Examiner*—Alyson M Merlino
(74) *Attorney, Agent, or Firm*—Rosenberg, Klein & Lee

(57) ABSTRACT

A lock includes a casing, an indicator movably received in the casing between a first position and a second position and a core received in the casing and so configured in such a way that a private key and a general key are able to activate the core. The movement of the indicator from the first position to the second position is in response to a status where the general key is applied to activate the core.

10 Claims, 16 Drawing Sheets

LOCK WITH INDICATOR AND MULTIPLE KEY-ACTUATED CORE

BACKGROUND OF THE INVENTION

1. Field of the Invention

The present invention relates to a lock, and more particularly to a lock having a core capable of being activated/deactivated by a private key and a general key and having an indicator to indicate the application of the private key or the general key respectively.

2. Description of the Prior Art

A lock is provided with a latch controllably and operably by the mechanism of the lock core. That is, when the lock core of the lock is in a locked position, the latch is secured to the casing of the lock and when the lock core is in the open position, the latch is freely movable relative to the casing. However, this conventional lock has no ability to indicate whether the core has been tampered with by an authorized or unauthorized personnel (normally the unauthorized personnel). In order to show who has accessed to the lock, U.S. Pat. No. 7,007,521 and U.S. Pat. No. 6,877,345 both provide mechanism to indicate different status in response to the activation method applied to the core of the lock structure so that the subsequent user of the lock may have the information of who had used the lock before him/her.

However, there is a disadvantage in the lock structure mentioned in the above patents. That is, the user has to memorize the combination in order to activate the lock core mechanism. Furthermore, the lock structure is incapable of indicating whether any unauthorized personnel has ever attempting to activate the lock core.

To overcome the shortcomings, the present invention tends to provide an improved lock structure to mitigate the aforementioned problems.

SUMMARY OF THE INVENTION

The primary objective of the present invention is to provide an improved lock having a core capable of being activated/deactivated by a private key and a general key so that the user of the lock structure of the present invention is no longer required to memorize the combination as used in the conventional lock.

Another objective of the present invention is that the lock structure of the present invention is provided with an indicator capable of showing whether the lock has been tampered with by unauthorized personnel.

Still another objective of the present invention is that the lock structure is provided with a latch seat firmly connected to the core and rotatably mounted on the casing of the lock so as to limit movement of the latch. Therefore, only when the core of the lock of the present invention is activated, is the latch seat rotated to limit or release the latch.

In order to accomplish the aforementioned objectives, the lock structure of the present invention includes a casing, a core rotatably received inside the casing, a latch seat firmly connected to the core so as to rotate simultaneously with the core and an indicator movably received in the casing between a first position where a private key is applied and a second position where a general key is applied and the indicator further including a clamp stamped from a periphery of the indicator to be received in a clamp hole in the latch seat such that after the indicator is moved upward to the second position, the clamp is received in the clamp hole of the latch seat to maintain the indicator in position.

Other objects, advantages and novel features of the invention will become more apparent from the following detailed description when taken in conjunction with the accompanying drawings.

DETAILED DESCRIPTION OF THE PREFERRED EMBODIMENT

Figure 1:
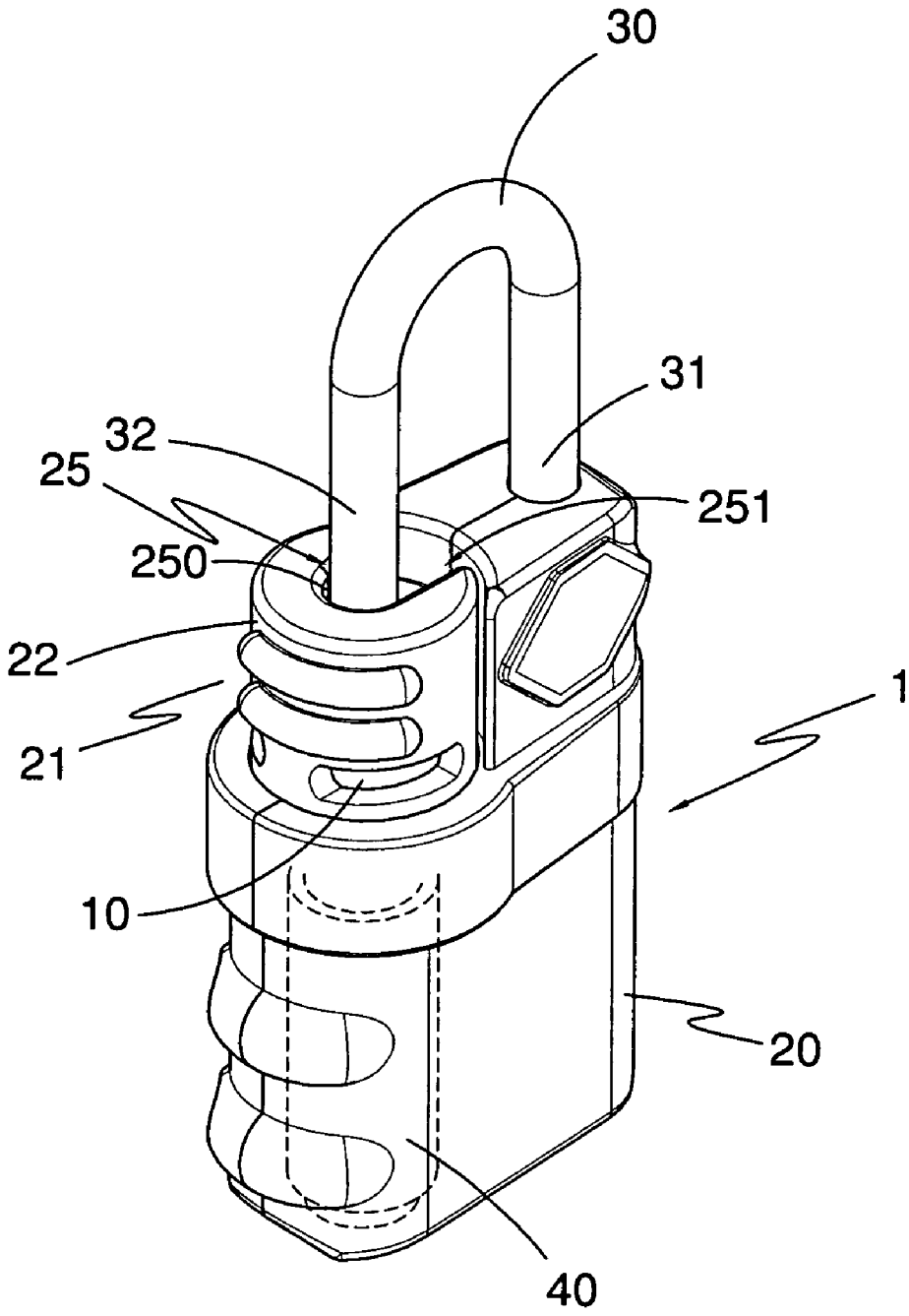
FIG. 1 is a perspective view of the lock structure of the present invention.

With reference to FIG. 1, it is noted that the lock structure 1 in accordance with the present invention includes a casing 20, a latch retaining member 21, a core 40 rotatably received in the casing 20, an indicator 10 movably received in the casing 20, the latch retaining member 21 including a latch seat 22 firmly connected to the core 40 to simultaneously rotate with the core 40 and rotatably mounted on top of the casing 20 and a latch 30 one end of which is securely received in the casing 20 and the other end of which is alternately received in the latch seat 22.

Figure 2:
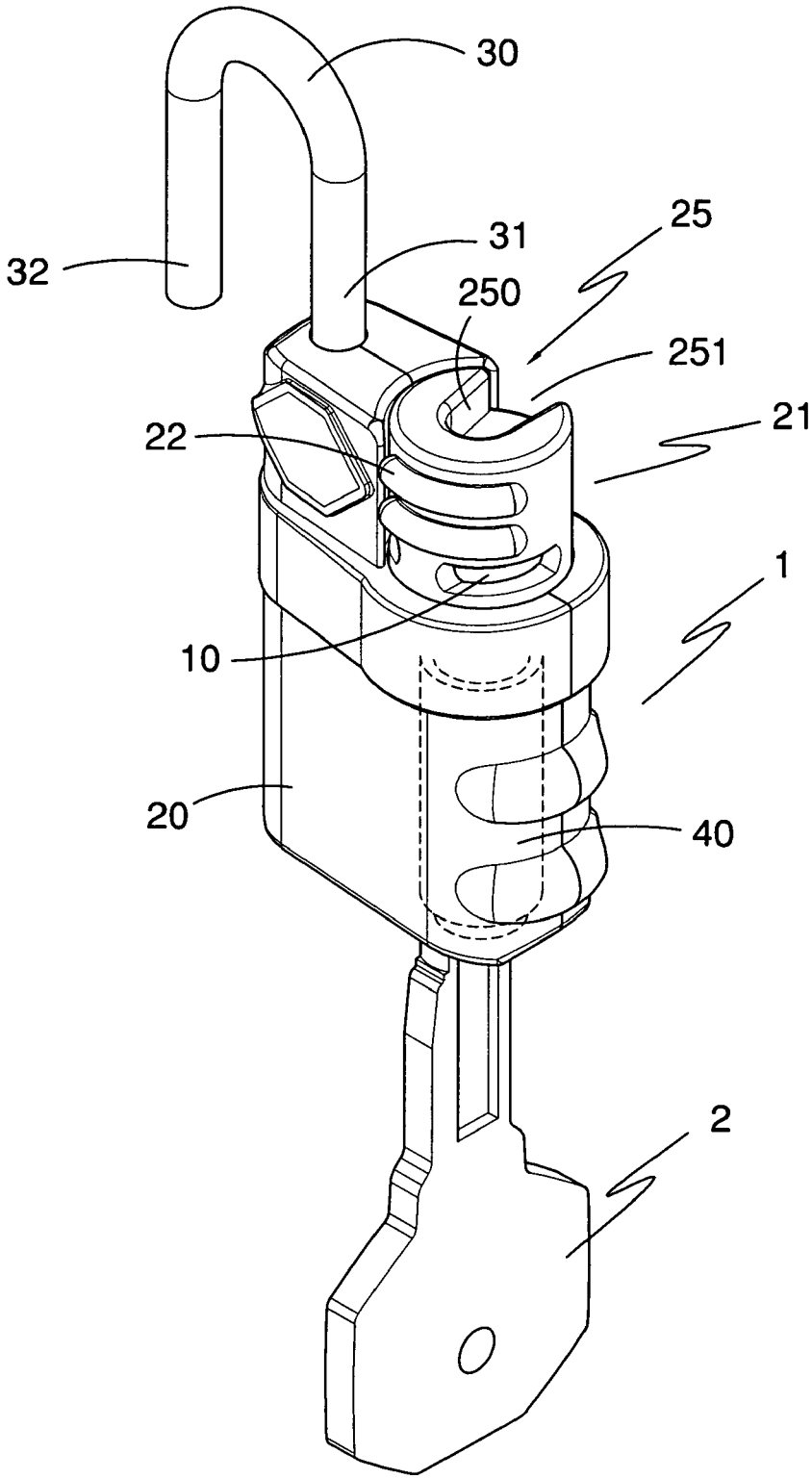
FIG. 2 is a perspective view showing that a private key is applied to activate the core of the lock structure of the present invention.
Figure 3:
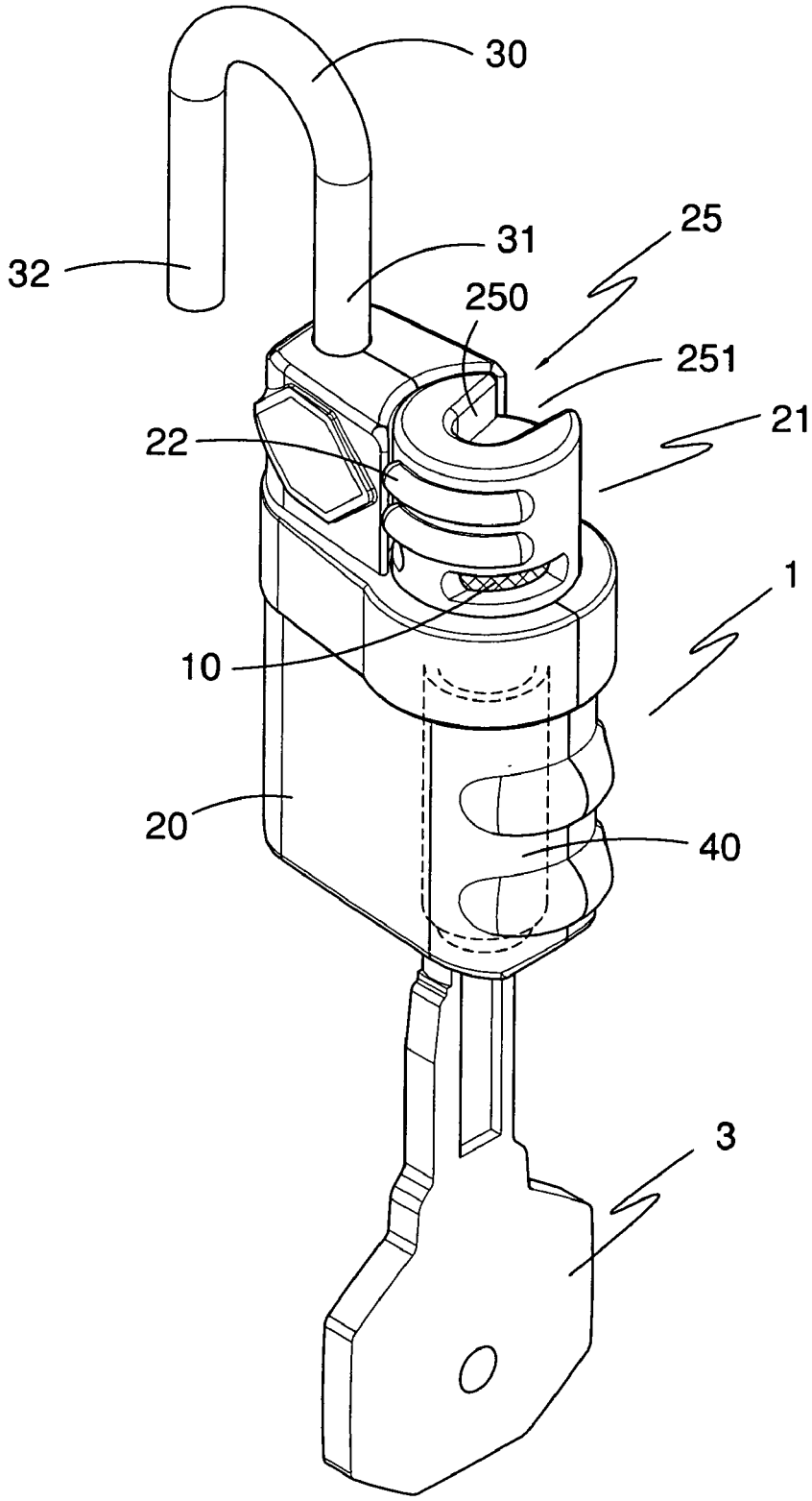
FIG. 3 is a perspective view showing that a general key is applied to activate the core of the lock structure of the present invention.

With reference to FIGS. 2 and 3, it is to be noted that the core 40 of the present invention is adapted for a private key 2 and a general key 3. That is, both the private key 2 and the general key 3 are able to activate the core 40 to drive the latch seat 22 to rotate so as to release a limitation to a free end of the latch 30.

Figure 4:
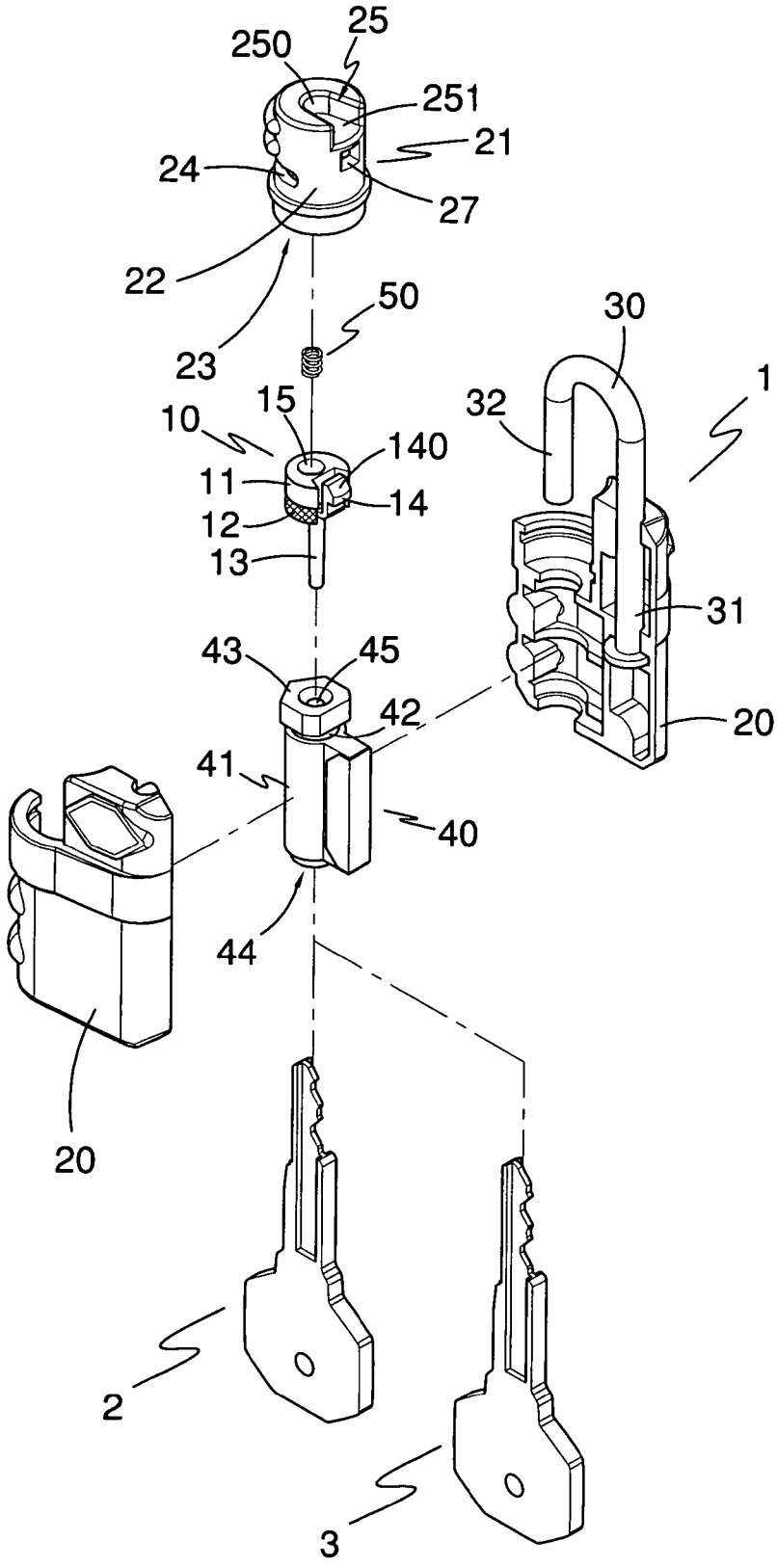
FIG. 4 is an exploded perspective view showing parts of the lock of the present invention.
Figure 5:
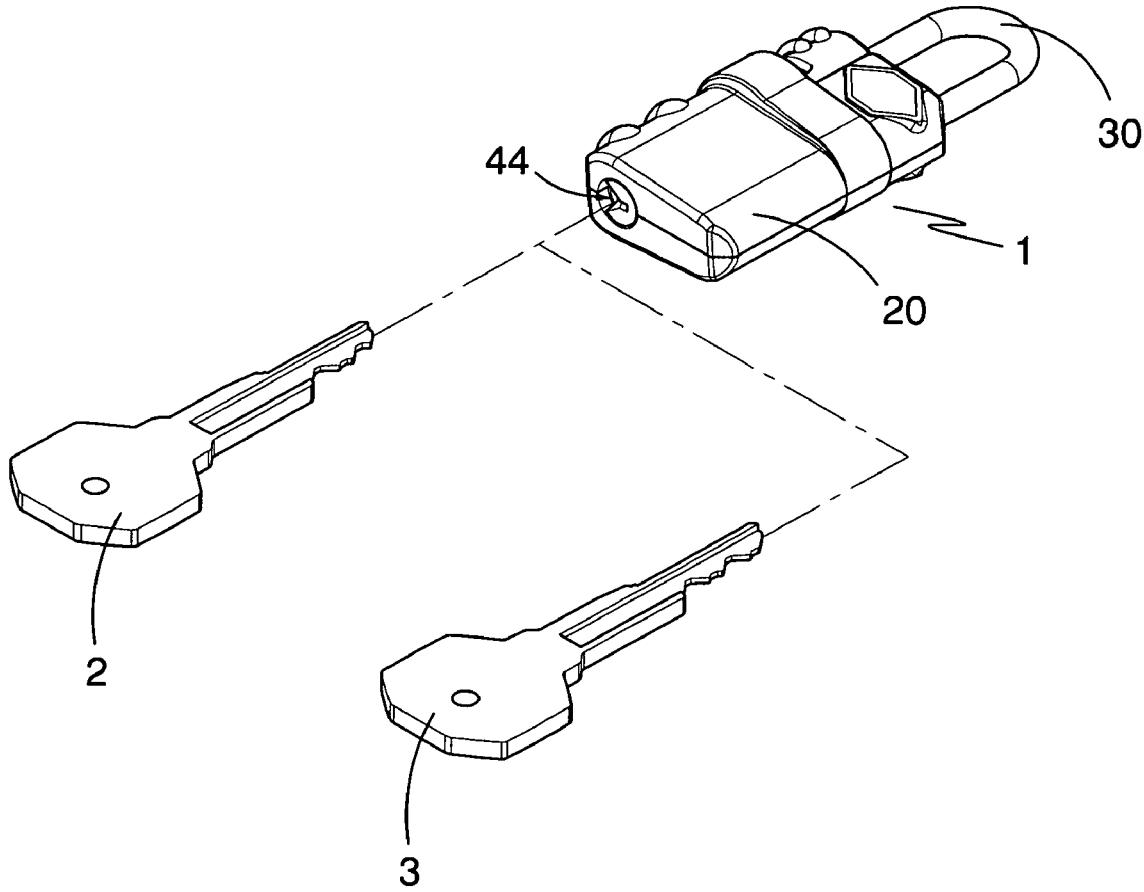
FIG. 5 is a perspective view of the lock showing the keyhole of the core.
Figure 6:
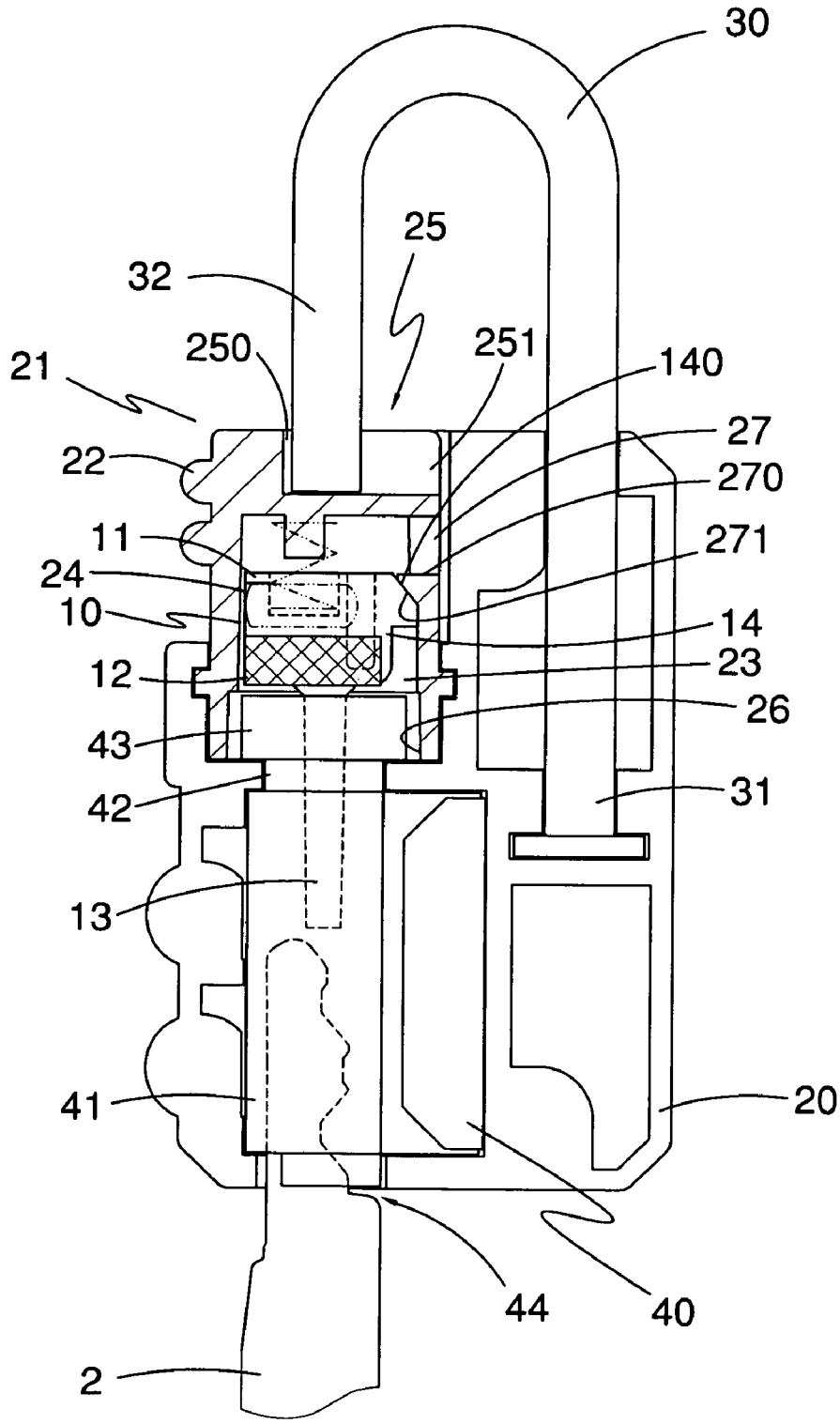
FIG. 6 is a schematic side plan view showing the application of a private key, wherein an extension from the indicator is free from engagement with the private key.

With reference to FIGS. 4-6, it is noted that the indicator 10 is composed of a first zone 11, such as a first annular ring 11, a second zone 12, such as a second annular ring 12 integrally formed with the first annular ring 11, an extension 13 extending from a bottom face of the second annular ring 12, a clamp 14 stamped out of an outer periphery of the first annular ring 11 and having a first beveled face 140 formed on a top face of the clamp 14 and a recess 15 defined in a top face thereof to receive therein a resilient element 50, preferably a spring as indicated. In the present invention, the first and second zones can be distinguished by applying different colors thereon, such as red and green.

The latch seat 22 is a cylinder with a compartment 23 defined in a lower portion thereof and provided with a guide pole 230 formed on a bottom face defining the compartment 23 so as to have the resilient element 50 mounted therearound, a window 24 defined in an outer periphery thereof to communicate with the compartment 23, a receiving recess 25 defined in a top face thereof and composed of a first opening 250 axially defined in a top face of the latch seat 22 and a second opening 251 defined in a side face of the latch seat 22 to communicate with the first opening 250, a receiving space 26 defined in a face defining an opening of the compartment 23 so as to communicate with the compartment 23 and a clamp hole 27 defined in the outer periphery thereof and positioned below the receiving recess 25. The clamp hole 27 corresponds to the clamp 14 of the indicator 10 so as to alternately receive the clamp 14 after the indicator 10 is moved upward relative to the casing 20. In addition, a boss 270 is formed on an inner periphery defining the compartment 23 and has a second beveled face 271 formed thereon to correspond to the first beveled face 140 of the clamp 14 of the indicator 10.

The latch 30 is composed of a root 31 which is securely and rotatably received inside the casing and a free end 32 extending out of the casing 20 to be alternately received and retained in the receiving recess 25.

The core 40 has a hollow cylinder 41 securely received in the casing 20, a drive shaft 42 rotatably received in the hollow cylinder 41, a head 43 firmly received in the receiving space 26 of the latch seat 22 to allow the latch seat 220 to rotate simultaneously with the core 40, a keyhole 44 defined in a lower portion of the hollow cylinder 41 and an extension hole 45 defined in the head 43 to correspond to and receive therein the extension 13 of the indicator 10.

Figure 7:
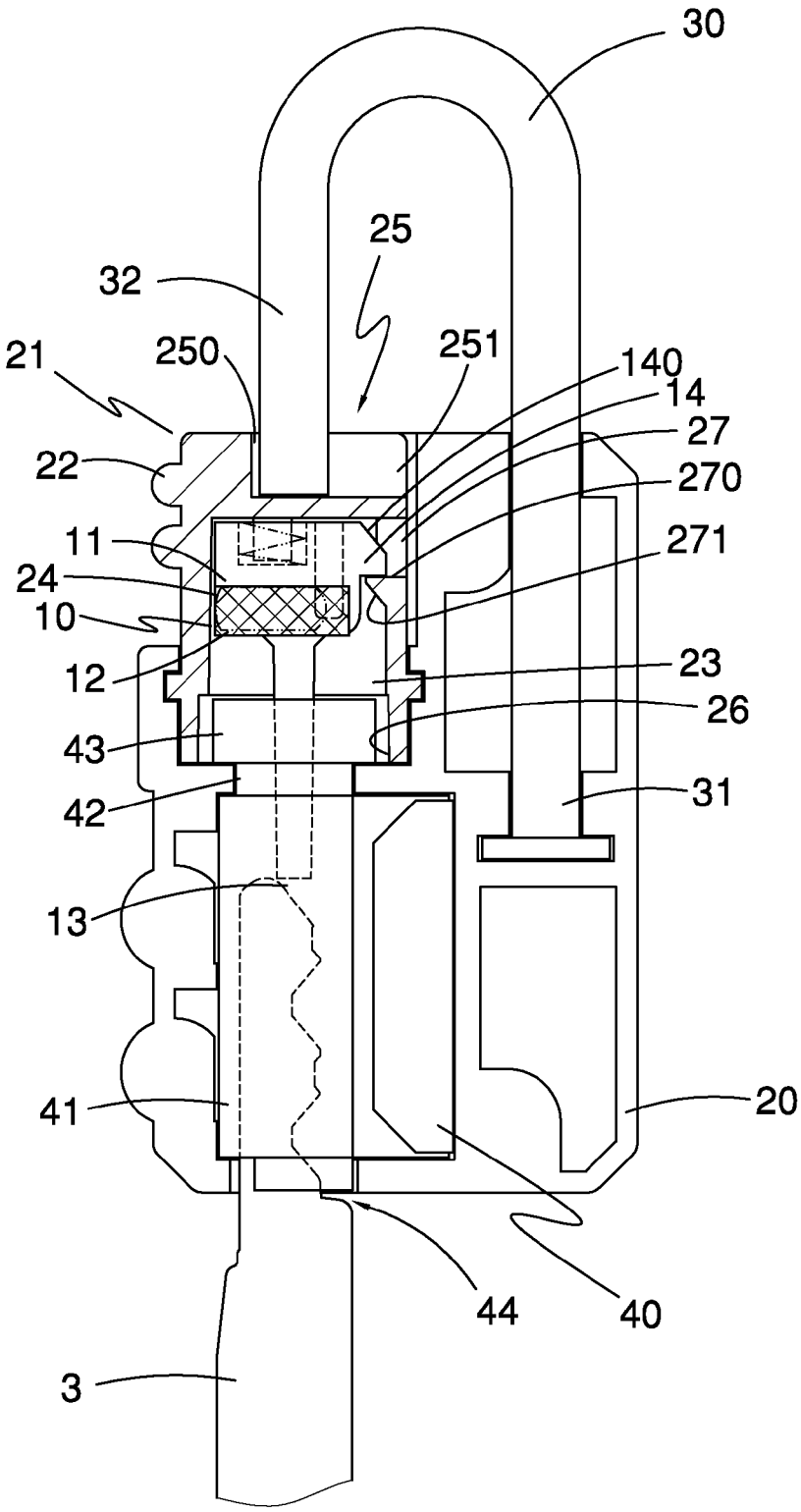
FIG. 7 is a schematic side plan view showing the application of a general key, wherein the extension from the indicator is engaged with the general key.
Figure 8:
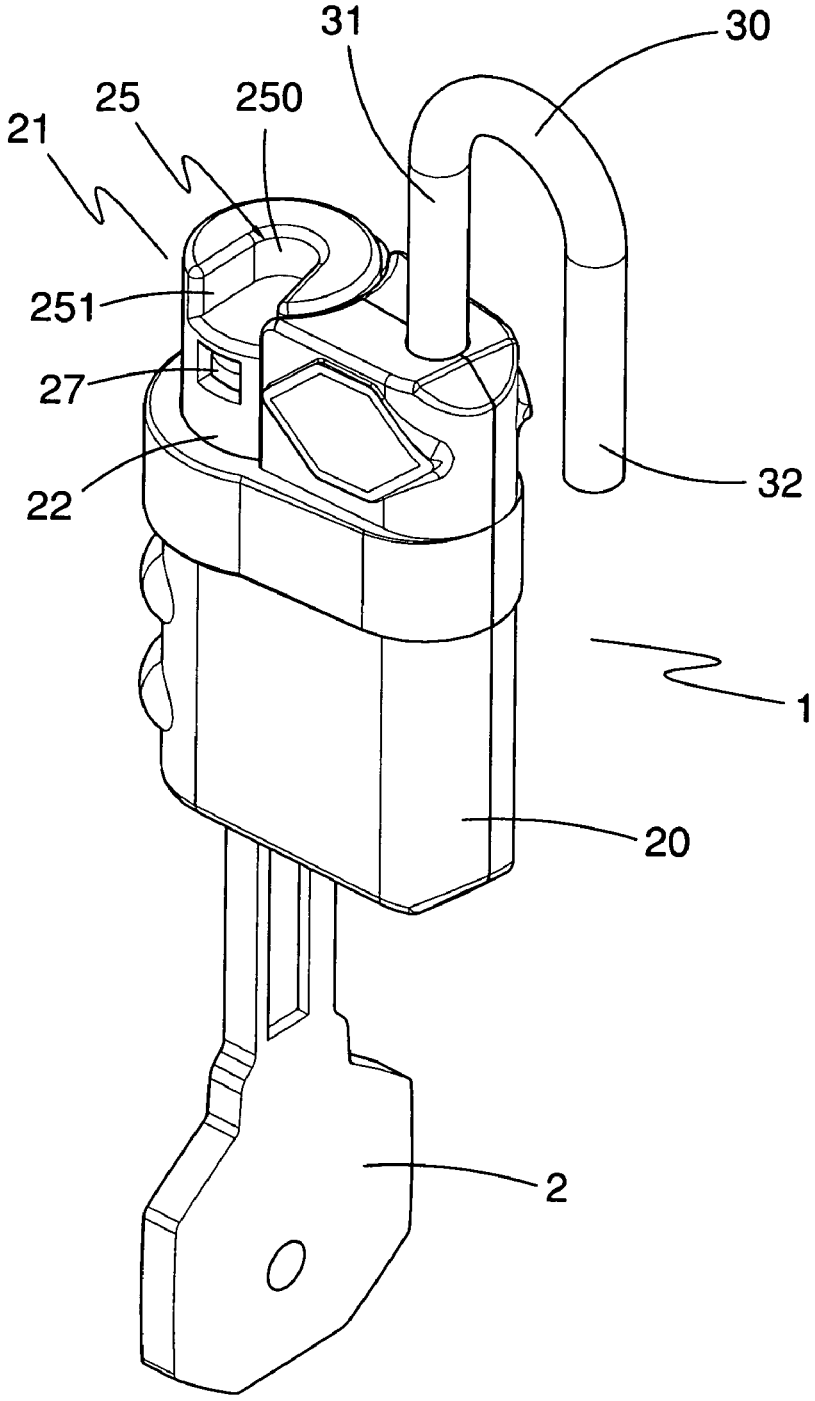
FIG. 8 is a perspective view showing the application of the private key to activate the core of the present invention.

With reference to FIGS. 6, 7 and 8 and still taking FIG. 1 for comparison, it is noted that after the above mentioned components are assembled, the head 43 of the core 40 is securely and firmly received in the receiving space 26 and the indicator 10 is received in the compartment 23 of the latch seat 22 with the extension 13 extending into the extension hole 45 of the core 40. Then the resilient element 50 is mounted around the guide pole 230 and received in the recess 15. Thus it is noted that when the private key 2 is inserted into the keyhole 44 of the core, the private key 2 is able to rotate the drive shaft 42. Consequently the latch seat 22 is rotated due to the head 43 being firmly received in the receiving space 26 so that the free end 32 of the latch 30 is retained or released by a peripheral wall of the casing 20.

Furthermore, when the private key 2 is inserted into the keyhole 44 of the core, the length of the private key 2 can not reach the free end of the extension 13 of the indicator 10 such that the indicator 10 is retained in position in the compartment 23 where the first annular ring 11 is exposed from the window 24. However, when the general key 3 is inserted into the keyhole 44 of the core 40, because the length of the general key 3 is longer than that of the private key 2, the distal end of the general key 3 engages with and pushes the free end of the extension 13 to move upward in the compartment 23, where the second annular ring 12 is then exposed from the window 24 to indicate that except the user of the private key 2, the person with the general key 3 has also activated the lock of the present invention. When an unauthorized personnel with an elongated tool is trying to unlock the lock of the present invention, the elongated tool will also push the free end of the extension 13 to show the second annular ring 12 from the window 24 such that the owner of the lock is able to find out that there is some unidentified personnel trying to tamper with the lock of the present invention.

Figure 9:
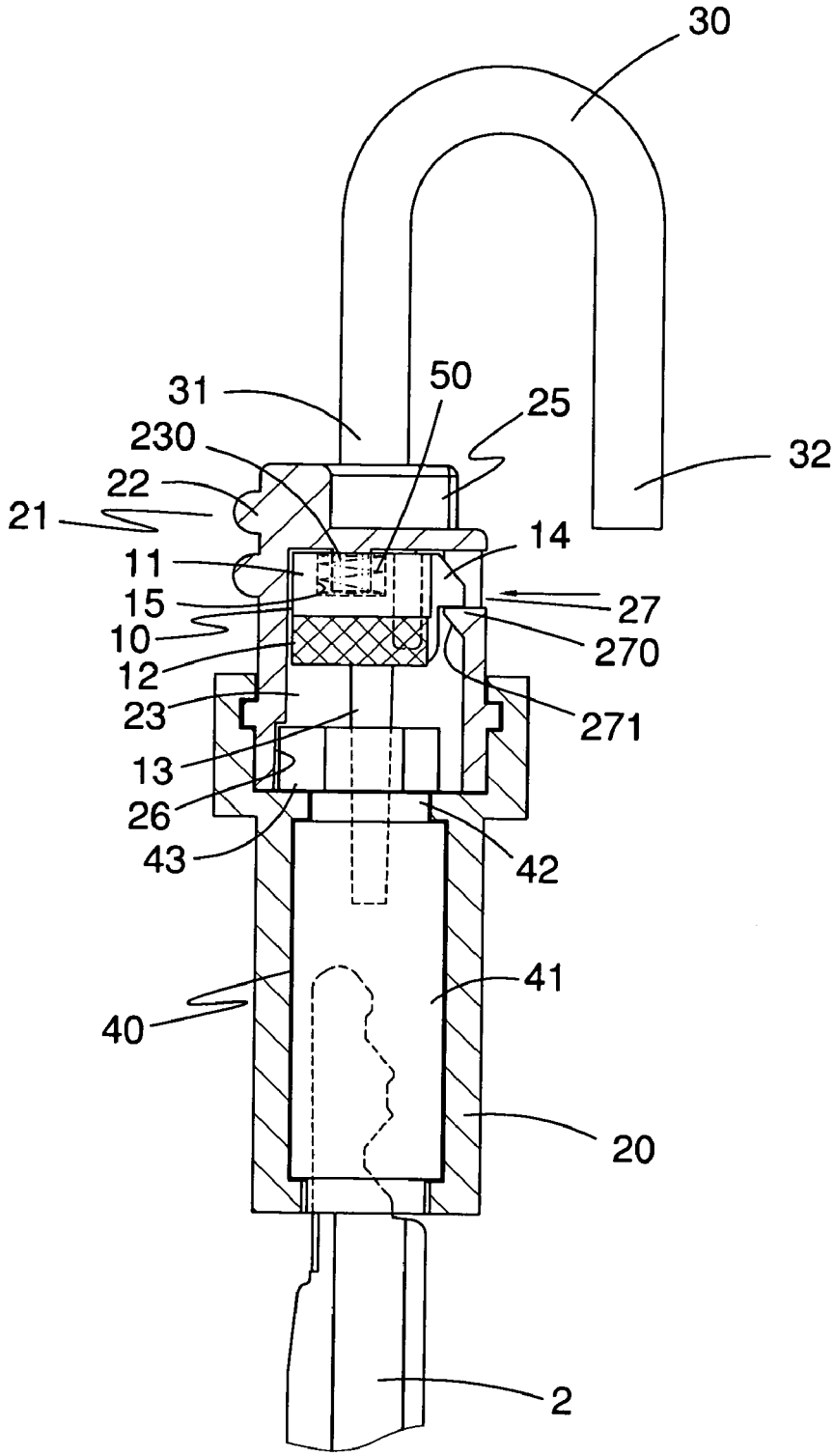
FIG. 9 is a schematic side plan view showing that the clamp of the indicator is received in the clamp hole in the latch seat.
Figure 10:
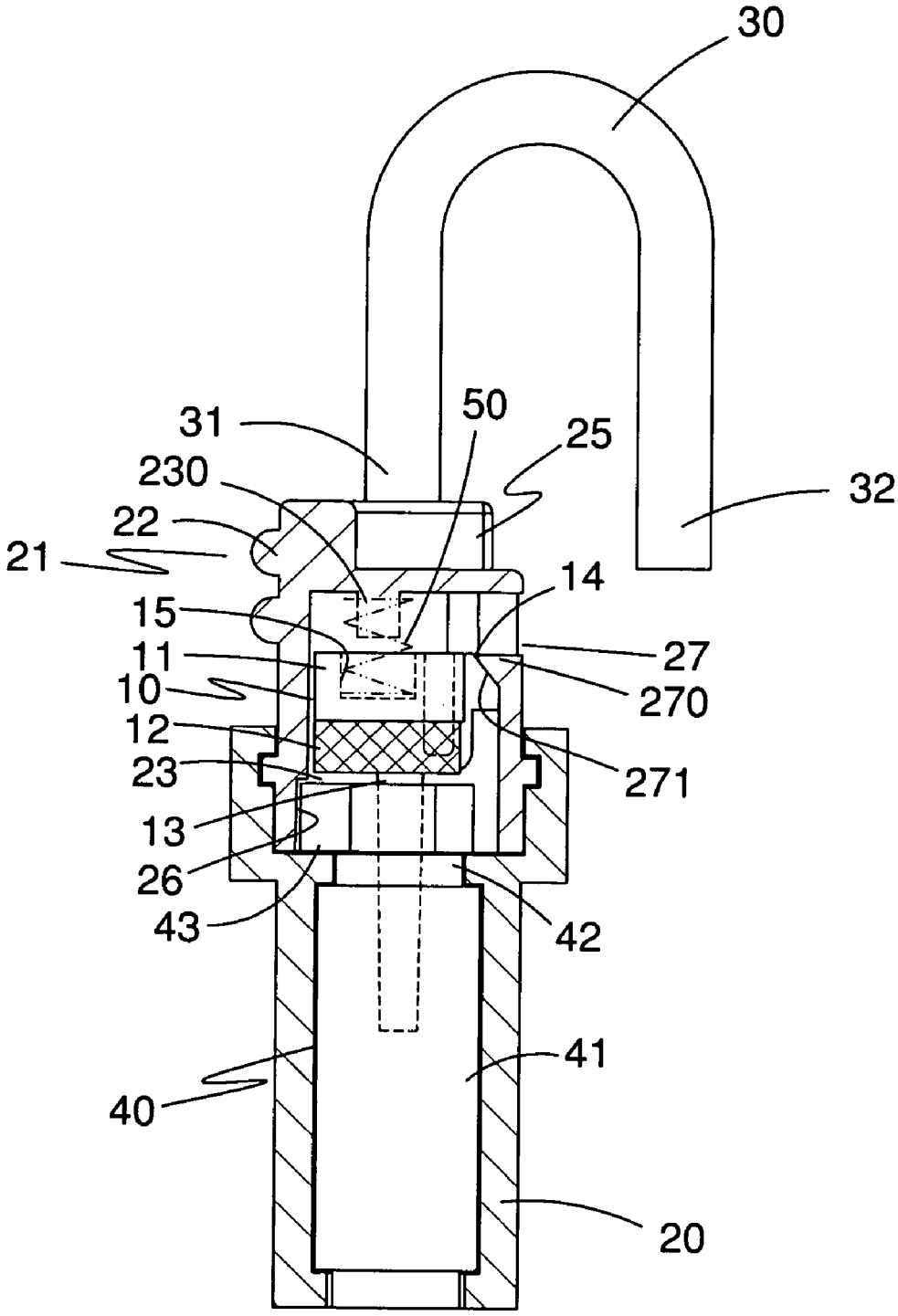
FIG. 10 is a schematic side plan view showing that the indicator is returned to its original position as a result of a recoil force after the clamp is pushed from the clamp hole.

With reference to FIGS. 7, 9 and 10, it is noted that after the general key 3 is inserted into the keyhole 44 of the core 40, the indicator 10 is pushed to move upward inside the latch seat 22 so that the second annular ring 12 is shown from the window 24. While the indicator 10 is moved upward, the first beveled face 140 of the clamp 14 that is stamped out from the outer periphery of the indicator 10 is first abutted by the second beveled face 271 of the boss 270 so as to move closer to the first annular ring 11. After the clamp 14 reaches the clamp hole 27, the clamp 14 springs out and is received in the clamp hole 27. During the upward movement of the indicator 10, the resilient element 50 is compressed to store a recoil force therein. To release the recoil force in the resilient element 50, the operator may use an auxiliary tool (not shown) to push the clamp 14 back into the compartment 23, then the indicator 10 is forced by the resilient element 50 to move back to its original position, where the first annular ring 11 is again exposed from the window 24.

Figure 11:
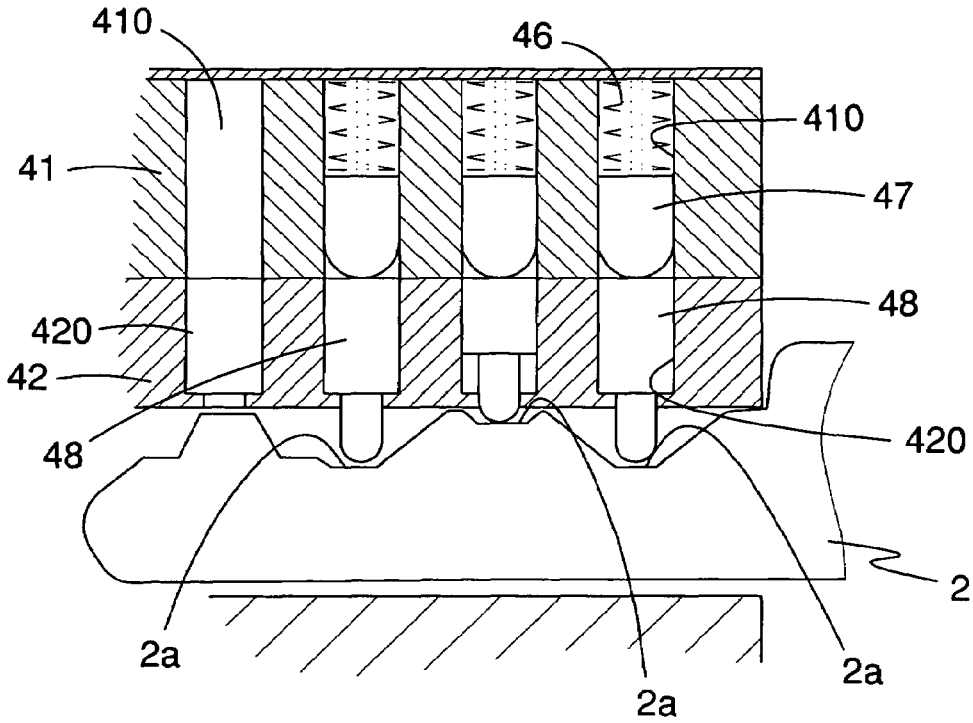
FIGS. 11, 12, 13A and 13B are schematic side plan views showing different embodiments of the core structure.
Figure 12:
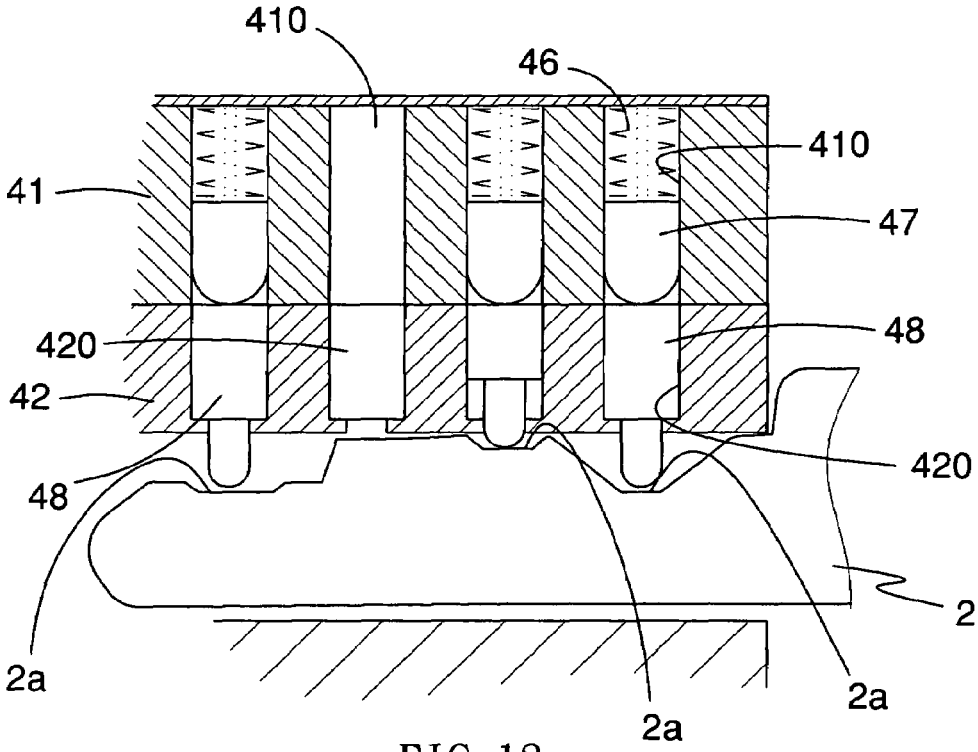

With reference to FIGS. 11 and 12, the cylinder 41 defines therein four first slots 410 and the drive shaft 42 of the core 40 has four second slots 420 respectively aligned with and communicating with the first slots 410. Inside the first slots 410, a combination of a pushing spring 46 and a first rod 47 is selectively received therein. Inside each of the second slots 420, a second rod 48 is selectively received therein to correspond to one of the first rod 47 that is received in the designated first slot 420. From the depiction of FIG. 11, it is noted that the first slot 410 and the first second slot 420 on the left of the drawing are not equipped with the combination of the pushing spring 46, the first rod 47 and the second rod 48. In accordance with this arrangement, the private key 2 is provided with indentations 2*a* formed on a peripheral edge thereof to correspond to the second rods 48 received in the second, third and fourth second slots 420 so that the private key 20 is able to drive the drive shaft 42 to rotate. In the present invention, the pushing spring 46, the first rod 47 and the second rod 48 are served as a controlling unit to control the rotation of the drive shaft 42.

With reference to FIG. 12, it is noted that the second first slot 410 and the second slot 420 are not provided with the combination of the pushing spring 46, the first rod 47 and the second rod 48. In accordance with this arrangement, the private key 2 is provided with first indentations 2*a* formed on a peripheral edge thereof to correspond to the second rods 48 received in the first, third and fourth second slots 420 so that the private key 2 is able to drive the drive shaft 42 to rotate.

Figure 13A:
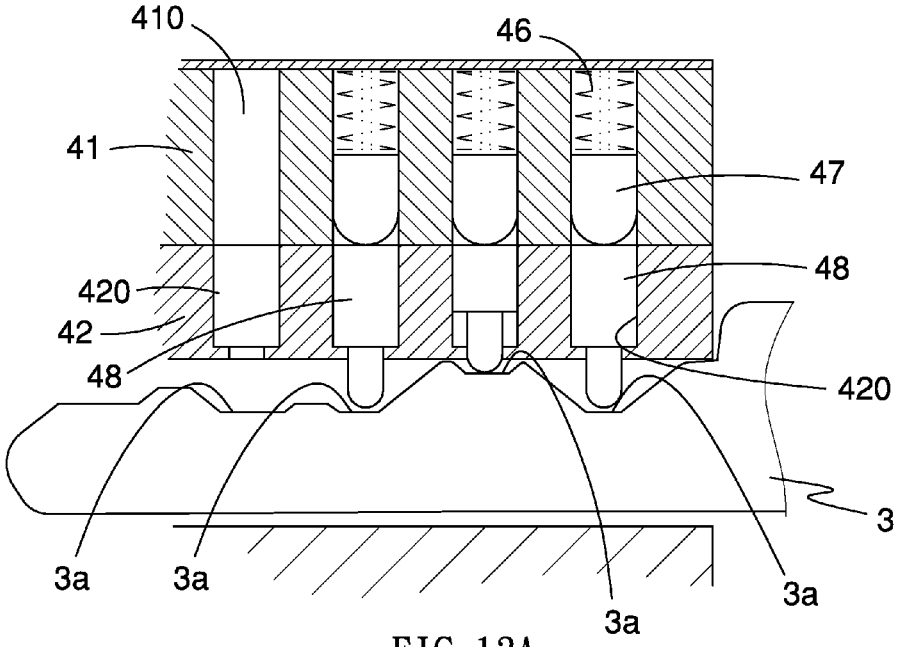
Figure 13B:
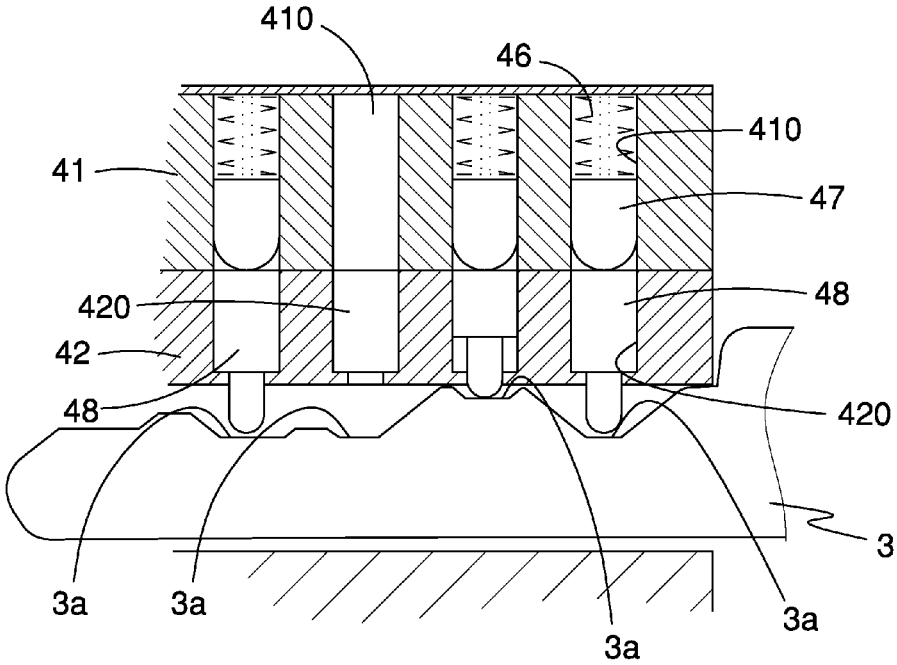

With reference to FIGS. 13A and 13B, it is noted that the general key 3 is provided with second indentations 3*a* formed on a peripheral edge thereof to correspond to the second rods 48 which are received in the second, third and fourth second slots 420 so that the general key 3 is able to drive the drive shaft 42 to rotate, as shown in FIG. 13A. In the embodiment shown in FIG. 13B, the second indentations 3*a* on the general key 3 are aligned with the second rods 48 in the first, third and fourth second slots 420 so that the general key 3 is able to drive the drive shaft 42 to rotate.

After the description, it is to be noted that whether the private key 2 or the general key 3 is employed to activate the core 40, both the private key 2 and the general key 3 are provided with indentations 2*a*, 3*a* to correspond to and align with the second rods 48. The design of the core 40 depends on which first slot 410 as well as the corresponding one of the second slots 420 is not equipped with the pushing spring 46, the first rod 47 and the second rod 48. Therefore, there are multiple choices for the structure of the core 40 of the present invention. As a result, if an unidentified key with indentations not corresponding to the empty second slots, the key will push the second rod 48 will be pushed out of a peripheral wall of the drive shaft 42, which hinders the rotation of the drive shaft 42 and the core 40 is not activated. Consequently, each private key 2 may only be used to activate a specific core 40. However, the general key 30 is designed to push all of the second rods 48 no matter how the arrangement of the second rods 48 is located in the second slots 420.

Although the above embodiment shows that the drive shaft 42 of the core 40 is provided with four sets of first slots 410 and four sets of second slots 420, the quantity of the slots 410,420 is not limited only to the embodiment. Similar design of the drive shaft 42 may be easily completed to allow each private key 2 may only be used to activate a specific core 40 and the general key 30 may be used to activate all the core 40.

In application, the private key 2 is owned by a private user and the general key 3 is owned by the custom personnel. Therefore, when the second annular ring 12 is exposed from the window 24, the private user will be able to know that the lock of the present invention was opened by the custom personnel.

Figure 14:
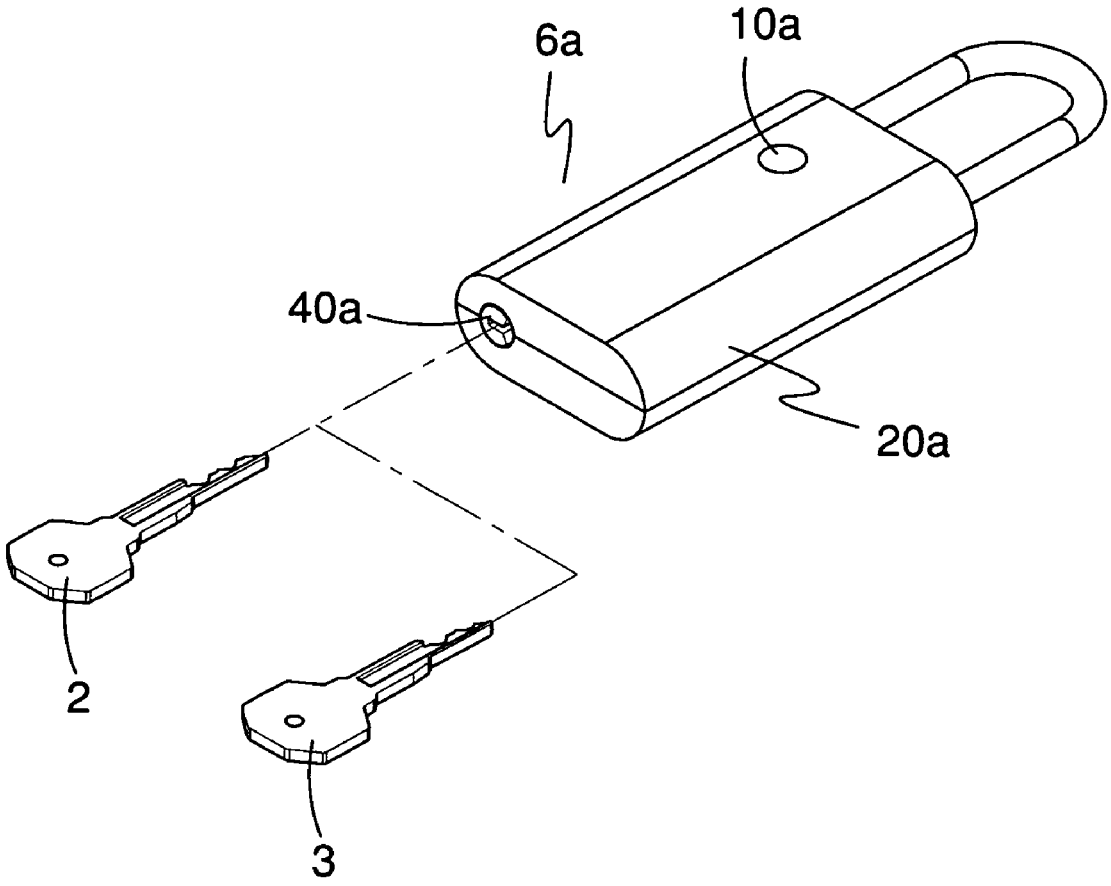
FIG. 14 is a perspective view showing a second embodiment of the casing of the lock.

Other embodiments as shown in FIGS. 14, 15, 16 and 17 may also use the concept of the core 40 and the indicator 10 of the present invention. For example, the embodiment in FIG. 14 shows a lock 6*a* without the latch seat of the present invention, but a core 40*a* and an indicator 10*a* inside the casing 20*a*.

Figure 15:
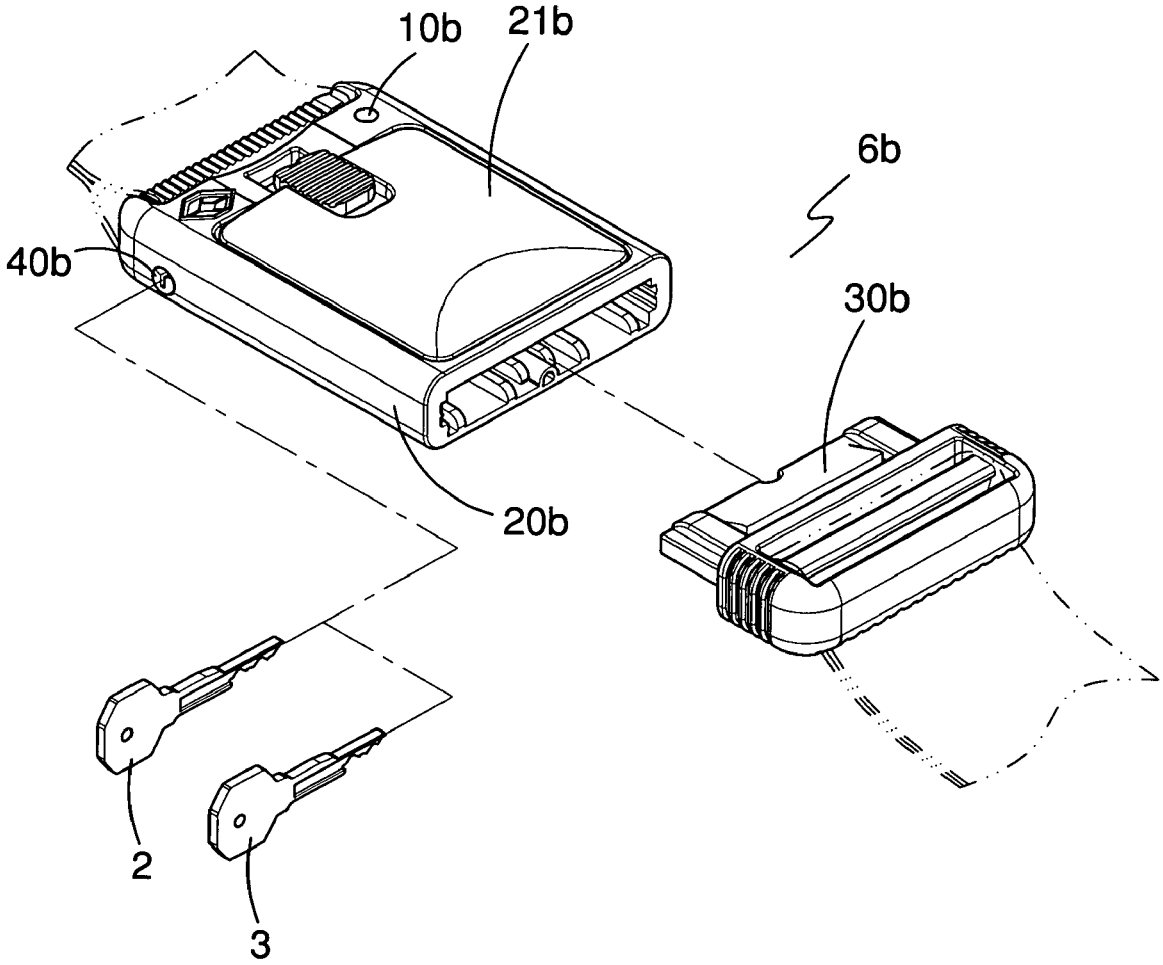
FIG. 15 is a perspective view showing a different embodiment of the present invention.

The lock structure 6*b* shown in FIG. 15, does not have the latch seat 22 and the latch 30 though, the plug 30*b* is substantially the same as that of the latch 30 and the latch member 21*b* is provided for connecting to the plug 30*b* is substantially the same as that of the latch seat 22. In this embodiment, the lock structure 6*b* has a core 40*b* and in indicator 10*b* received in the casing 20*b*, which function substantially the same as those in the embodiment of the present invention.

Figure 16:
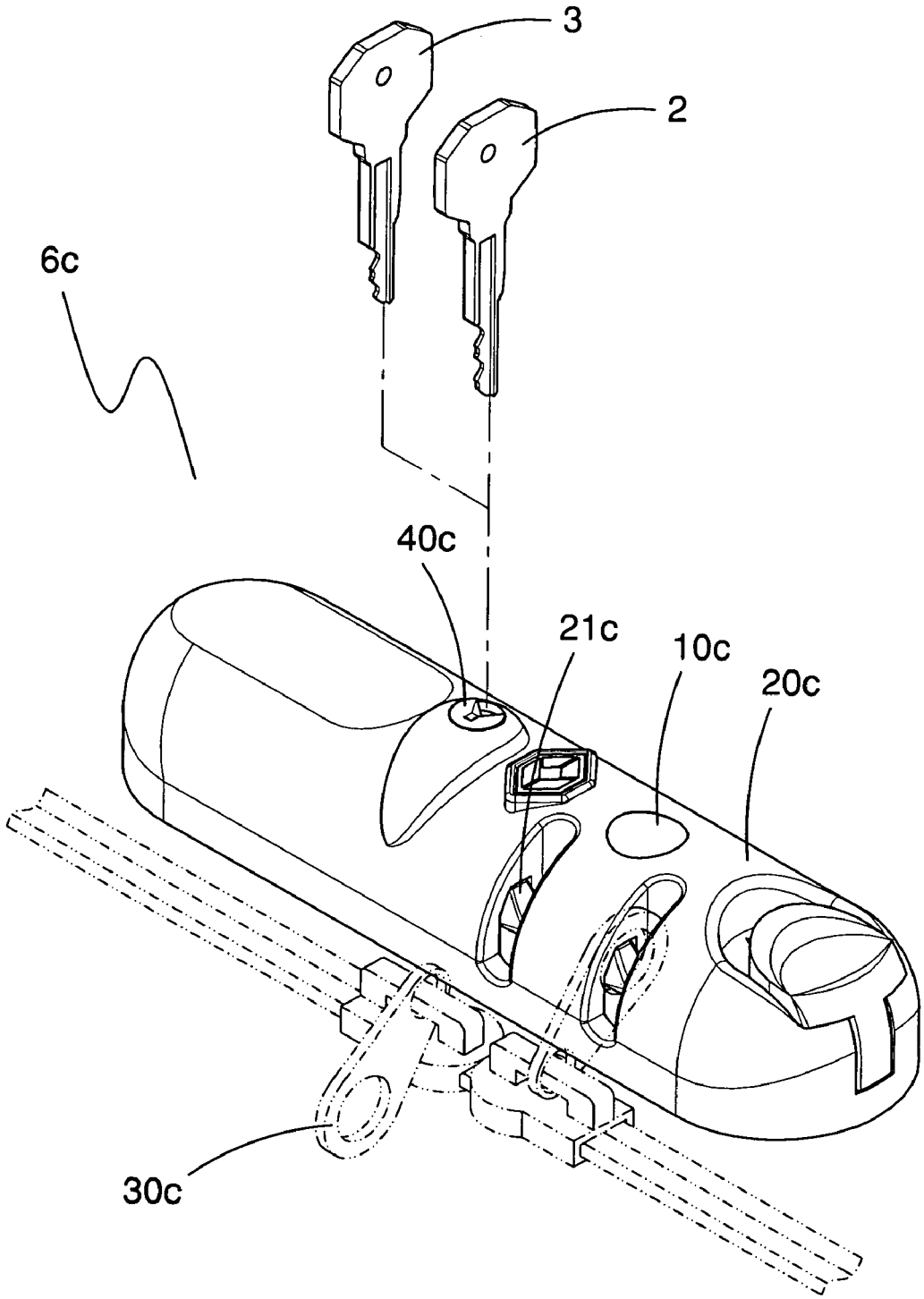
FIG. 16 is a perspective view of still another embodiment of the present invention.

The lock structure 6*c* shown in FIG. 16, does not have the latch seat 22 and the latch 30 though, the zipper plate 30*c* is substantially the same as that of the latch 30 and the clamping element 21*c* for connection to the zipper plate 30*c* is substantially the same as that of the latch seat 22. In this embodiment, the lock structure 6*c* has a core 40*c* and in indicator 10*c* received in the casing 20*c*, which function substantially the same as those in the embodiment of the present invention.

Figure 17:
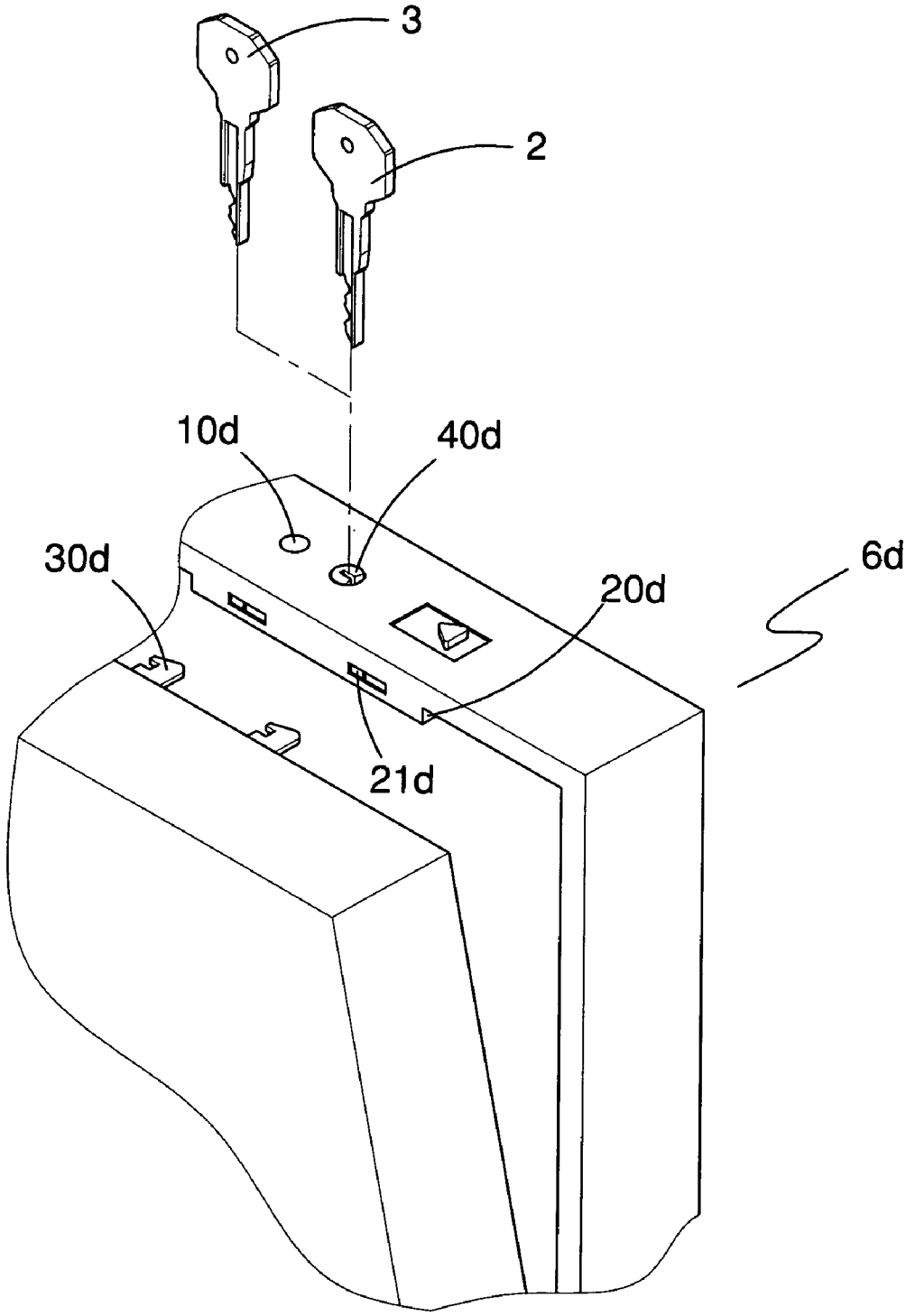
FIG. 17 is a perspective view of another embodiment of the present invention.

The lock structure 6*d* shown in FIG. 17, does not have the latch seat 22 and the latch 30 though, the hook 30*d* is substantially the same as that of the latch 30 and the clamping element 21*d* for connection to the hook 30*d* is substantially the same as that of the latch seat 22. In this embodiment, the lock structure 6*d* has a core 40*d* and in indicator 10*d* received in the casing 20*d*, which function substantially the same as those in the embodiment of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock comprising:

a casing;

an indicator movable between a first position and a second position relative to the casing;

a core received in the casing and having a keyhole defined in an end thereof to alternately receive therein a private key and a general key in such a way that either one of the private key and the general key is able to activate the core, wherein the indicator moves from the first position to the second position in response to a status where the general key is inserted into the keyhole of the core;

a latch having a root rotatably received inside the casing and a free end extending from the root; and a latch seat provided with a receiving recess to receive therein the free end of the latch, wherein the latch seat is exposed to the casing and connected to the core so that when the core is activated, the latch seat is moved in response to the movement of the core to limit or release the free end of the latch, and wherein the latch seat has a compartment defined therein to receive the indicator and a window in communication with the compartment.

2. The lock as claimed in claim 1, wherein the indicator has a first zone and a second zone integrally formed with the first zone, wherein when the indicator is at the first position, the first zone is exposed from the window and when the indicator is at the second position, the second zone is exposed from the window.

3. The lock as claimed in claim 1, wherein the core includes a cylinder received in the casing and a drive shaft rotatably mounted in the cylinder in response to the activation of the private key and the general key, the latch seat is connected to the drive shaft such that the latch seat is rotated via the rotation of the drive shaft.

4. The lock as claimed in claim 1, wherein the core has an extension hole defined in a top face thereof to communicate with the keyhole to receive therein an extension extending from the indicator such that when the general key is inserted into the keyhole, the extension of the indicator is pushed by the general key to push the indicator from the first position to the second position.

5. The lock as claimed in claim 1, wherein the latch seat further has a clamp hole defined in an outer periphery of the latch seat, the indicator has a clamp to be detachably received in the clamp hole.

6. The lock as claimed in claim 5, wherein a resilient element is compressibly received in the indicator so as to receive therein a recovery force when the indicator is moved to the second position.

7. The lock as claimed in claim 6, wherein the drive shaft has a head and the latch seat has a receiving space defined in an opening of the compartment to communicate with the compartment, the head is firmly received in the receiving space so that when the drive shaft is rotated, the latch seat is rotated.

8. A padlock comprising:

a casing;

a latch connected to the casing and movable relative to the casing, the latch having a free end disposed outside of the casing, wherein the free end of the latch approaches or leaves the casing by moving the latch;

a core received in the casing and comprising a drive shaft defining a key hole for receiving either one of a private key and a general key, wherein the drive shaft rotates when either one of the private key and the general key is inserted into the key hole and is rotated;

an indicator movable relative to the casing and capable of being pushed to a sensible position by the general key directly; and a latch seat connected to the casing and drivable by the drive shaft of the core to limit or release the free end of the latch, wherein the latch seat has a compartment defined therein for receiving the indicator and a window in communication with the compartment, and the indicator in the sensible position is visible through the window.

9. The padlock as claimed in claim 8, wherein the indicator is placed on the latch seat.

10. The padlock as claimed in claim 8, wherein the indicator has an extension which is accessible by the general key only.

* * * * *